US008468648B1

(12) United States Patent
Smith et al.

(10) Patent No.: US 8,468,648 B1
(45) Date of Patent: Jun. 25, 2013

(54) METHOD AND APPARATUS FOR CLEANING AIR CONDITIONER EVAPORATOR COILS

(76) Inventors: Ricky D. Smith, West Monroe, LA (US); Randy Wilkerson, West Monroe, LA (US)

( * ) Notice: Subject to any disclaimer, the term of this patent is extended or adjusted under 35 U.S.C. 154(b) by 1386 days.

(21) Appl. No.: 12/215,469

(22) Filed: Jun. 26, 2008

(51) Int. Cl.
*A47L 5/24* (2006.01)

(52) U.S. Cl.
USPC ..... 15/381; 15/344; 15/389

(58) Field of Classification Search
USPC ..... 15/344, 383, 389, 327.5, 381
IPC ..... A47L 5/24,5/36
See application file for complete search history.

(56) References Cited

U.S. PATENT DOCUMENTS

2002/0092118 A1* 7/2002 Nunzio et al. ..... 15/329
2008/0289138 A1* 11/2008 Yang et al. ..... 15/326

* cited by examiner

*Primary Examiner* — David Redding

(57) ABSTRACT

An air conditioning coil cleaning system including a portable vacuum blower equipped with a plurality of fluid supply reservoirs and a fluid pump, a suction hose with an electric power cord and fluid supply lines attached to a remote hand held brush head containing an elongated oscillating wiper brush. Fluids may be selectively sprayed onto coils being cleaned while vacuuming to reduce airborne debris and debris accumulation in the coil catch pan.

5 Claims, 5 Drawing Sheets

METHOD AND APPARATUS FOR CLEANING AIR CONDITIONER EVAPORATOR COILS

1. FIELD OF THE INVENTION

This invention relates generally to wet or dry vacuum systems and more particularly to a portable wet or dry vacuum system with a unique brush head used principally for gently cleaning and vacuuming fine particulate matter from hard to reach AC evaporator coils.

2. GENERAL BACKGROUND

Dirt and other contaminates, such as grease, pollen, hair spray, etc., on air-conditioning coils present a serious maintenance problem in residential or commercial buildings. Dirty coils reduce airflow, decrease efficiency, reduce HVAC capacity, and are a major cause of compressor failure and sick building syndrome.

Indoor coils known as evaporator coils are located in the air handler portion of the system and are generally fitted with intake filters. Filtering is important because indoor coils are located in tight spaces within the air handler ductwork and so they are difficult and expensive to clean. Therefore, a filter is the first line of defense against contaminate intrusion into the system. However, such filters are often not efficient or the framing around the filter is improperly fitted, thereby allowing contaminates in the air to circumvent the filter. In addition such filters are often neglected and become ineffective.

Indoor coils located within the air handling system are also fitted with drain pans to collect and dissipate moisture buildup from the coil. These pans also require careful cleaning to prevent their accumulated debris from producing molds that may becoming airborne and polluting the air passing through the coil.

The most efficient and most expensive and time-consuming way to clean an evaporator coil is to pump down the Freon and disconnect the lines from the coil, tape over all the open ends of the lines, take the front cover off the coil and slip it forward out of the case, then clean with steam or high pressure using a solvent prescribed for such coils. Then one must reverse the order of removal and reconnect the refrigerant lines. A vacuum must be imposed on the lines for at least an hour before releasing Freon back into the system. Only a person certified to work with Freon must do this process. Further care must be taken to contain the mess created by coil removal and cleaning, but containment and careful cleanup is important to protect indoor air quality.

Other methods for cleaning evaporator coils may be used. Provided sufficient space is available, a bottle brush may be used to clean the coil to some degree. However, loosening such debris simply allows the contaminates to become airborne or settle in the drain pan which may contain water, thereby requiring additional effort to clean. Coils positioned in an up-flow furnace system require a covering over the furnace heat exchangers to keep debris from falling down into the furnace. Often a bottlebrush and a squeeze bottle of water is used in this process to keep the contaminates on the coil damp, thus missed contaminants become even more adhered to the coil and thus harder to remove. In some cases alkaline cleaners are effective at cutting greasy dirt encountered on indoor coils. Grease comes from skin flakes and cooking. Using powerful foaming cleaners requires experience and extreme caution, especially indoors where fumes could sicken the technician or building occupants. The use of such foam cleaners also results in a sticky residue on the coil and, if not removed with a water bath and brush, will actually attract contaminates and make them harder to remove at the next cleaning.

Since the evaporator coils are covered with very fine, very sharp fins that serve as heat exchangers, care must be taken to insure that these fins do not become damaged. High pressure water or vigorous brushing may damage the fins and thus reduce the effectiveness of the coils' ability to exchange heat. In the tight, very confined space within the air handling system it is very hard to prevent such damage with water bottles, spray cans and conventional brushes.

The most common type of AC coil is the A-frame type whereby a pair of coils is arranged back-to-back forming an "A". Such coils are placed in the air handling system so as to pass intake air across the coils, using a blower fan, and into the ventilation ducts. Contaminates in the air stream tend to settle on the face of one coil and on the under side of the adjacent coil. Using brushes, foams, water spray and the like to clean the exterior faces of coils while in place simply forces the contaminates further into the coils because of inaccessibility of the coils from either side.

Conventional vacuum systems have been used to assist the bottlebrush process, but, again, the brush loosens contaminates that either fall into the drain pan or remain airborne. A conventional vacuum system head, in some cases, may be used that has a non-active brush or a rotary brush that has very short bristles, commonly used for cleaning furniture, neither of which are particularly efficient in vacuuming coil fins in such narrow confines, nor do they have the size or reach to extend through the coil fins from either side. Bristle type and size is essential to effective cleaning of any coil having fins and especially so in evaporator coils. Bristles for this purpose should be sufficiently tough to resist being cut by the sharp fins, yet be fine enough to slide easily between the fins and still be sufficiently rigid to remove the contaminates. A vacuum brush should also be driven so as to loosen and remove by vacuum, and possibly vibration, all contaminates within the confines of the coil's air handling compartment while effectively containing airborne elements.

3. SUMMARY OF THE INVENTION

The vacuum system disclosed herein overcomes the problems described above by providing an improved vacuum system that includes a portable vacuum blower equipped with a plurality of fluid supply reservoirs and a fluid pump, a suction hose with electric power cord and fluid supply liners attached to a remote hand held brush head containing an elongated, oscillating wiper brush. The brush head utilizes a collapsible skirt around its perimeter to produce a more effective vacuum between the brush head and the evaporator coils being cleaned. Fluids may be selectively sprayed onto coils being cleaned while vacuuming to reduce airborne debris and debris accumulation in the coil catch pans.

It is therefore an object of the invention to provide a portable vacuum system having a plurality of fluids for effecting the cleaning of hard to access AC coils while vacuuming away loose debris.

It is a further object of the invention to provide a driven brush head with a plurality of bristles located axially within an elongated cavity that gently oscillate in a to and fro sweeping manner and which extend deep within fins surrounding the coils, thereby combing the fins in a parallel manner.

It is still a further object of the invention to provide a collapsible perimeter wall that enhances the ability of the brush head to provide a strong vacuum around the sweeper brush while allowing the brush bristles to penetrate deeply within the coil fins with gentle pressure applied to the brush head by the user.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
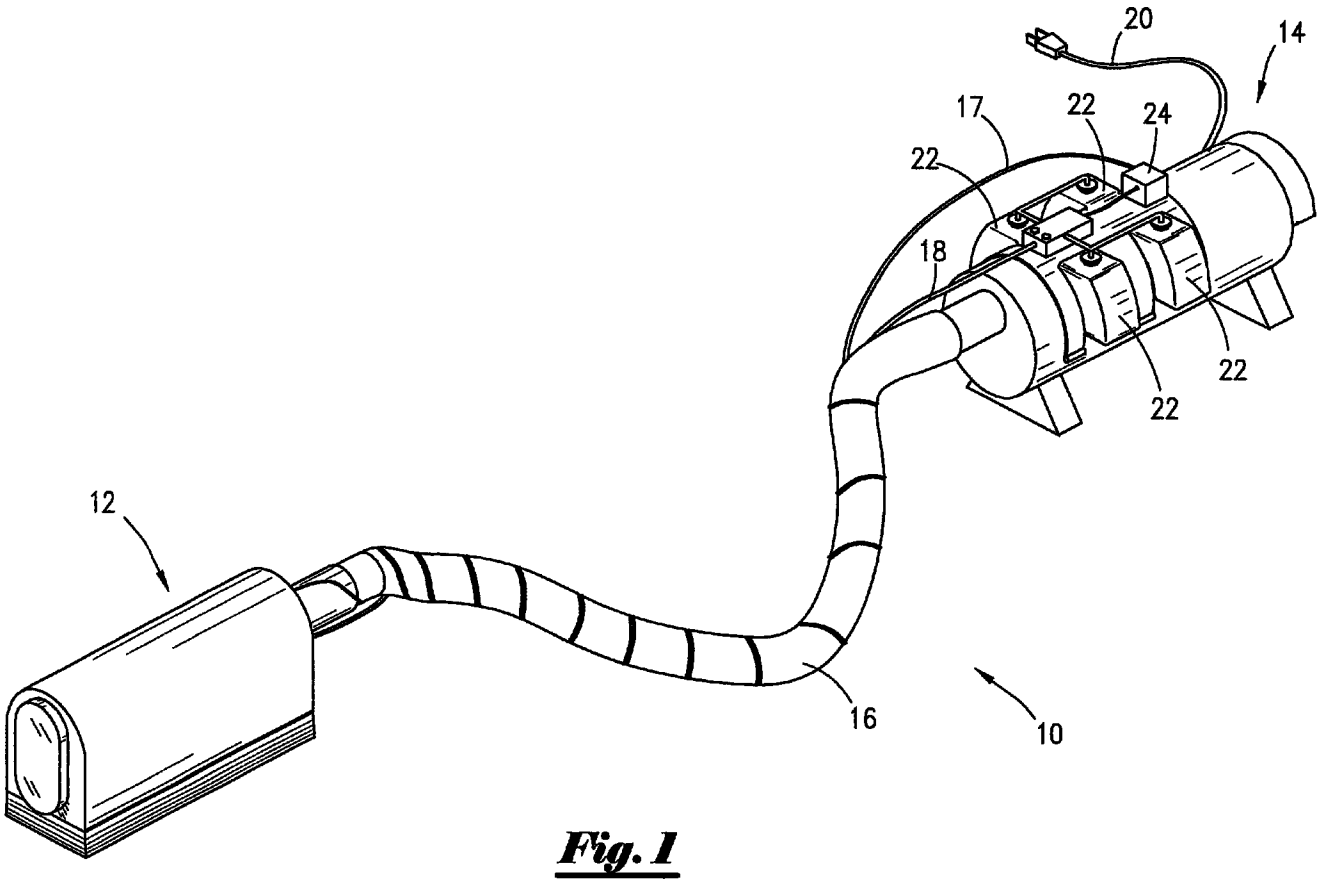
FIG. 1 is an isometric assembly view of the coil brush head and the vacuum pump assemblies.

The coil cleaning assembly 10, seen in FIG. 1, is made up of a brush head assembly 12 and a wet or dry vacuum assembly 14 connected by an umbilical vacuum hose 16 having an electrical connection cord 17 and a fluid hose 18 attached. The vacuum assembly also includes a power supply cord 20, a plurality of fluid reservoirs 22 and a fluid pump 24 attached electrically to the vacuum assembly and fluidly to the fluid hose 18 leading to the brush head assembly 12. The vacuum assembly 14 is a lightweight portable unit of the type that may be carried on a shoulder strap. However, other forms of vacuum units may be employed as the need may dictate. Various types of fluids, such as water, degreasing foam agents bactericides, antioxidants, etc., may be provided in the reservoirs 22. The fluid pump 24 applies pressure to the various fluids which may be selected by a valve located in the system adjacent the pump.

Figure 2:
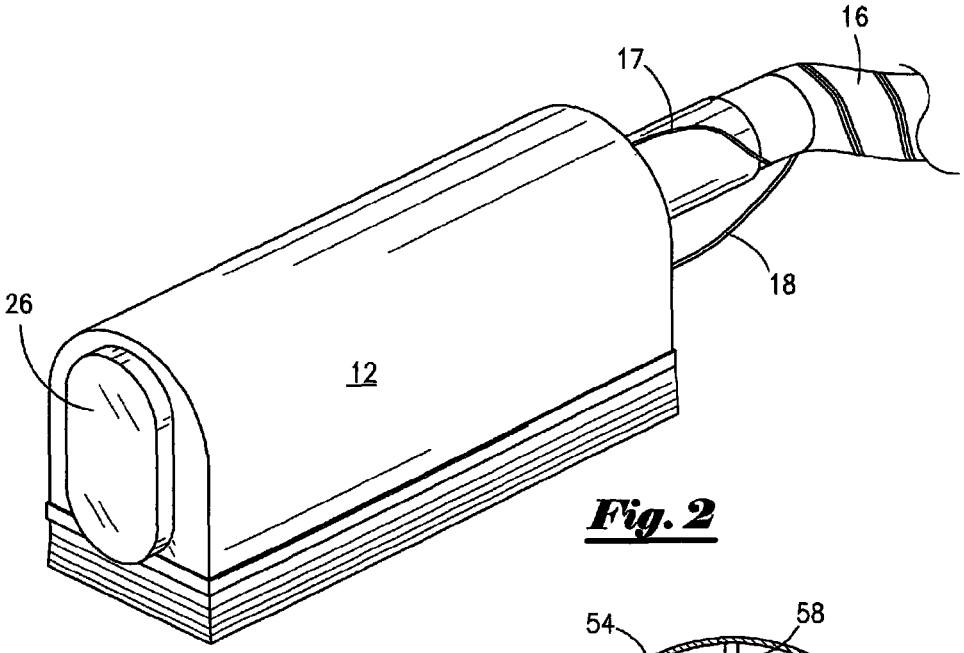
FIG. 2 is an isometric view of the vacuum brush head assembly.
Figure 4:
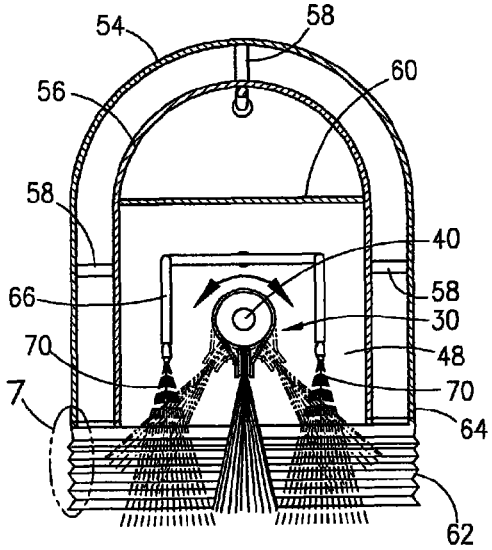
FIG. 4 is a cross-section view taken along sight lines 4-4 seen in FIG. 5.
Figure 3:
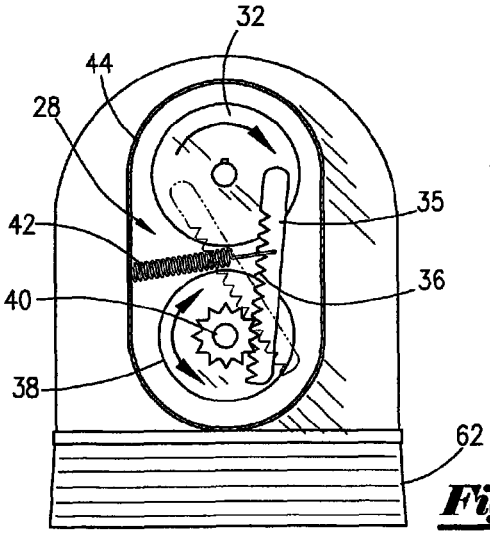
FIG. 3 is an end view of the brush head assembly with the drive assembly exposed, as taken along sight line 3-3 seen in FIG. 5.
Figure 5:
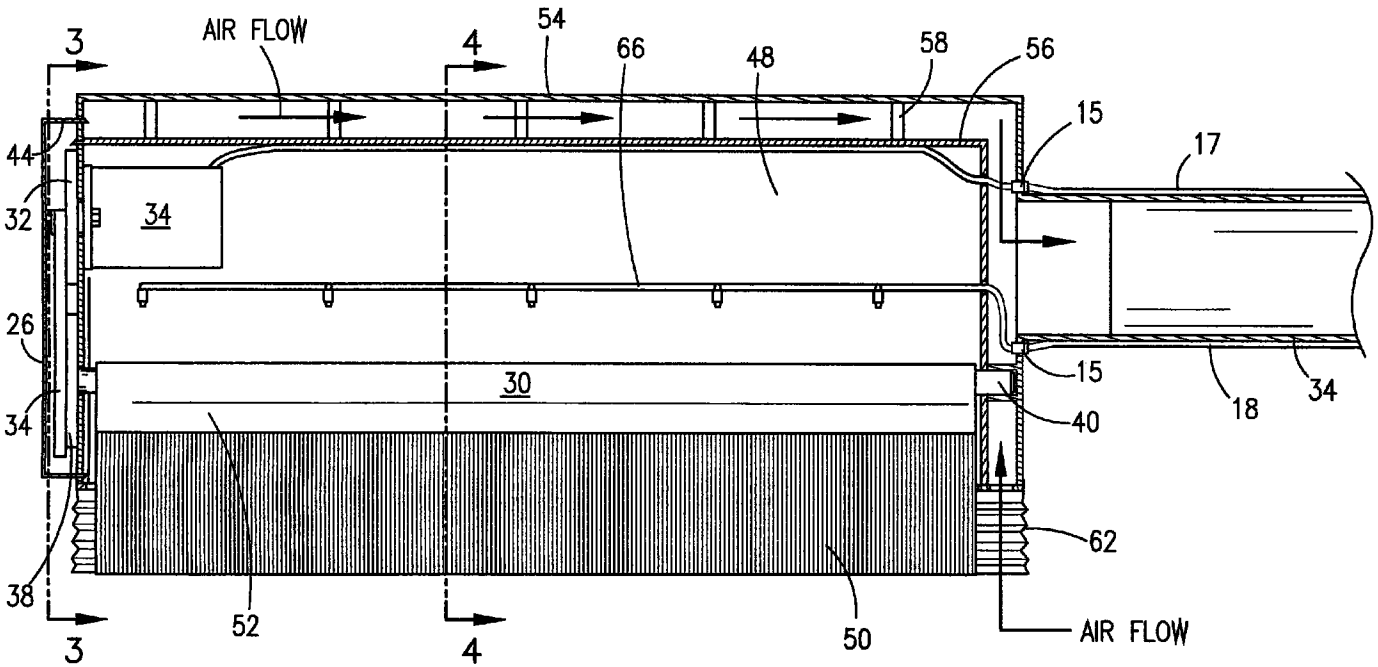
FIG. 5 is a longitudinal cross-section view of the coil brush head assembly taken along sight lines 5-5 seen in FIG. 6.
Figure 6:
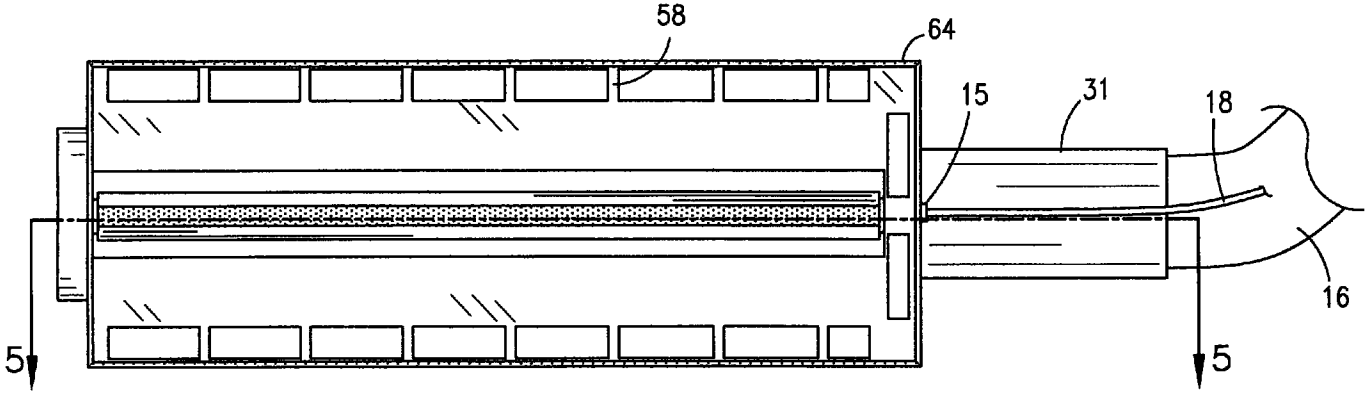
FIG. 6 is a bottom view of the coil brush head assembly.

The brush head assembly 12 includes a connection 31 for attaching the vacuum hose 16 and connections for fluid line 18 and electrical connection cord 17, as shown in FIG. 6. As seen in FIG. 2, the cover 26 is located at the end of the brush head assembly 12 at an end opposite the hose connection 31 and encloses the drive assembly 28, shown exposed in FIG. 3, for the sweeper brush assembly 30, seen in FIG. 4. Drive assembly 28 includes a drive wheel 32 attached to the drive motor 34, better seen in FIG. 5, located within the brush head sweeper brush cavity 48 and electrically connected to the electrical cord 17. As seen in FIG. 3 the drive wheel 32 includes an offset pivot arm 35 having teeth 36 along one edge for engaging a cog and wheel assembly 38 attached to a brush spindle 40. A spring 42, attached to the pivot arm 35 at one end and the drive housing 44 at the other end, maintains tension on the arm, thereby insuring engagement between the pivot arm 35 and the cog and wheel assembly 38. Other means for maintaining contact between the pivot arm 35 and the cog and wheel assembly 38 may be used, such as a compression coil spring or leaf spring. With the drive wheel 32 rotating clockwise, the pivot arm 35 is thrust in alternating directions, thereby rotating the cog assembly 38 alternatively clockwise and counterclockwise, which in turn drives the brush assembly 30 about its central longitudinal axis in an alternatively sweeping motion with an included angle of travel of approximately 60 degrees via a spindle 40 extending longitudinally through the sweeper brush assembly 30, as seen in FIGS. 4, 5. The sweeper brush assembly 30 extends longitudinally through the brush cavity 48 and is retained upon spindle 40. The brush assembly includes an elongated "U" shaped member 52 carried by the spindle 40 in a manner whereby when compressed clamps the bristles 50 along the length of the "U" shaped member 52. The bristles 50 may be made of any desired materials but preferably metal, polymeric or a combination thereof.

Returning to FIG. 4 and as seen in FIGS. 5 and 6, we see that the brush head assembly 12 includes an elongated outer "U" shaped shell 54 and an elongated "U" shaped inner shell 56 separated and spaced apart by spacers 58, thereby leaving an air flow path between the two shells 54, 56. Therefore, as seen in FIGS. 5 and 6, air suction is created by the suction side of the vacuum blower assembly 14 whereby air is drawn into the brush head 12 around the outer perimeter of the inner shell 56 by the vacuum assembly 14 via hose 16.

A partition 60, as seen in FIG. 4, divides the cavity 48 into upper and lower portions or cavities, thereby isolating the drive motor 34 from exposure to water, dust and chemicals present in the lower cavity with the sweeper brush assembly 30.

Figure 8:
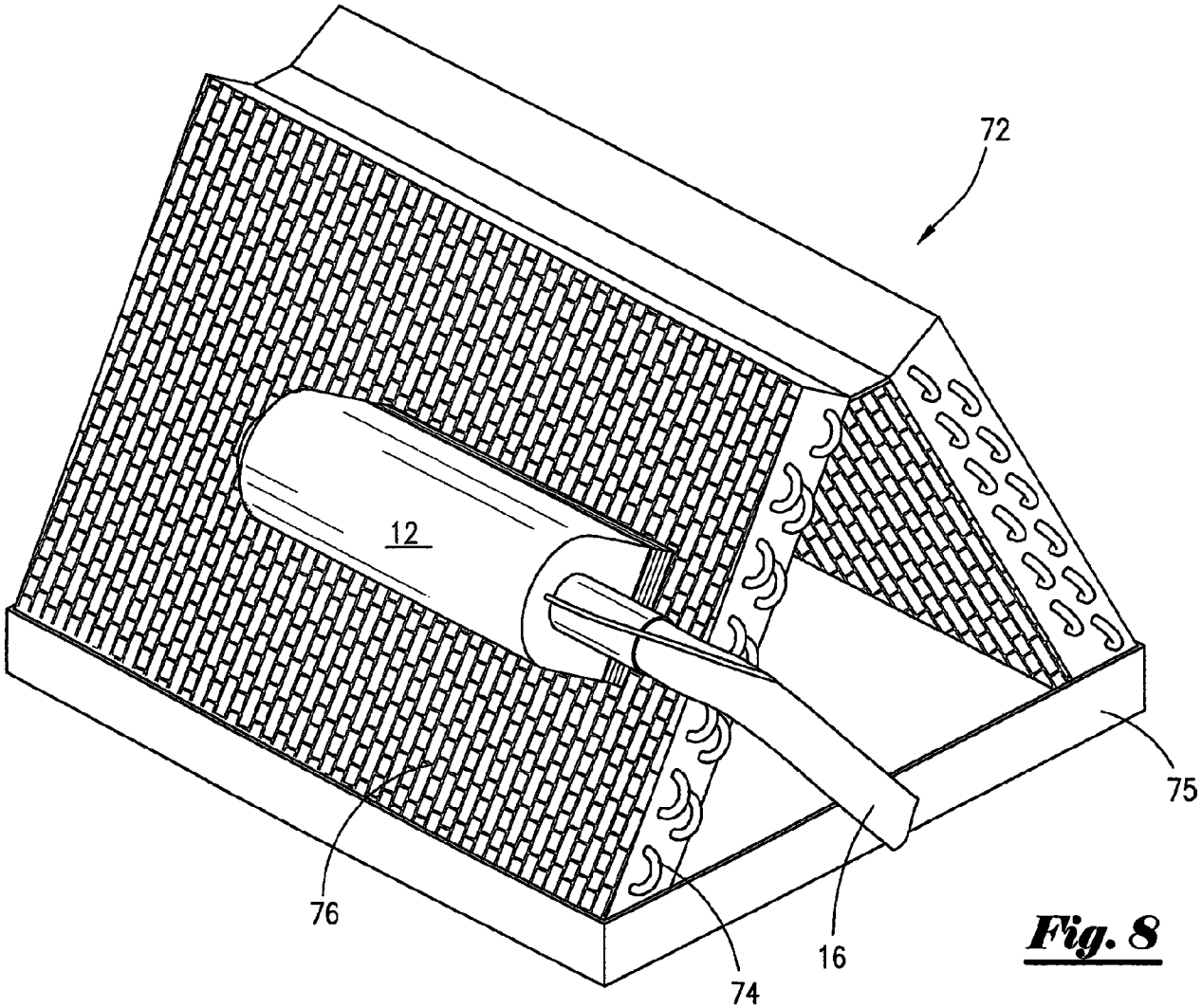
FIG. 8 is an isometric view of the coil brush head assembly in contact with an air conditioning evaporator coil assembly.

As also seen in FIG. 4 and FIG. 5, one or more internal fluid lines 66 may be connected to fluid supply hose 18 that extend parallel to and along the length of the sweeper brush assembly 30, thereby providing cleaning and washing fluids as needed for removing debris from the coils 72 while vacuuming such debris before it becomes air-born or is deposited into hard to access and clean catch pans 75 located below the coils, as seen in FIG. 8. The fluid lines 66 may have very small holes located along their length or fitted with nozzles that produce a spray pattern as seen in FIG. 4. Both sides of the coil may be cleaned using the brush head 12 or modifications thereof.

Figure 7:
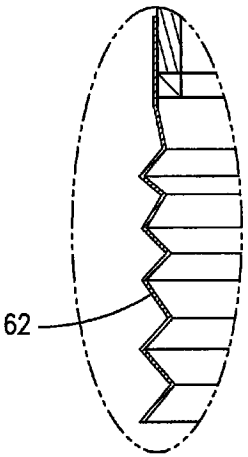
FIG. 7 is a expanded partial view of the flexible skirting identified as area 7 seen in FIG. 4.

A collapsible corrugated wall or skirt 62, better seen in FIG. 7, surrounds and is attached to the lower edge perimeter 64 of the outer shell 54 seen in the bottom view of FIG. 6, thereby forming a partial seal between the brush head assembly 12 and the coils 72 seen in FIG. 8. The brush head assembly 12 may be used to vacuum debris from both inner and outer faces of the coils 74.

In operation the user carries the vacuum blower assembly 14 attached to a power supply and the attached brush head to a location adjacent an evaporator coil 74 or other such coils to be cleaned. In some cases the vacuum blower may be battery powered, in which case there is no need for a 120 V power cord 20 or its connection to a power supply. The user starts the vacuum blower and gently moves the brush head into contact with the coil assembly 72, as seen in FIG. 8, so as not to damage the fins 76 surrounding coil tubing 74. Slight pressure is exerted on the brush head 12 to insure penetration of the sweeper bristles 50 between the coil's fins 76. The brush head 12 is lifted and moved to a new location on the face of the coil assembly 72. After all loose material has been removed from all coil faces, the process may be repeated using selected fluids supplied from the reservoirs 22 via the fluid lines 18, 66 to further clean the coils 74 and thus loosen caked on debris. After removal of all debris, a fresh water spray may be selected while sweeping to insure removal of all chemical residue on the coils.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A vacuum cleaning apparatus for cleaning between the fins of an air conditioning coil comprising:

a) a portable vacuum blower assembly;

b) a vacuum hose attached to a suction side of said vacuum blower assembly;

c) a means for electrically driving said vacuum bower assembly;

d) an elongated brush head assembly attached remotely to an end of said vacuum hose opposite said blower assembly;

e) a sweeper assembly located within said brush head assembly having an elongated bristle retaining member, with a plurality of bristles attached thereto, extending the approximate length of said brush head assembly;

f) a means for continuously driving said bristle retaining member axially in alternating directions between said fins of air conditioning coils; and g) wherein said bristles extend from said bristle retaining member sufficient distance to reach beyond said vacuum blower assembly thereby penetration between said fins of air conditioning coils.

2. The wet and dry vacuum cleaning apparatus according, to claim 1 wherein said means for continuously driving said sweeper assembly is an electric motor assembly.

3. A vacuum cleaning apparatus for cleaning between the fins of an air conditioning coil comprising:

a) a portable vacuum blower assembly;

b) a vacuum hose attached to a suction side of said blower assembly;

b) a means for electrically driving said vacuum blower;

c) an elongated brush head assembly attached remotely to an end of said vacuum hose opposite said blower assembly d) a sweeper assembly located within said brush head assembly having an elongated bristle retaining member, with a plurality of bristles attached thereto, extending the approximate length of said brush head assembly;

e) a means for continuously driving said bristle retaining member axially in alternating directions between said fins of air conditioning coils; and f) wherein said brush head assembly further comprises a collapsible skirt.

4. A vacuum cleaning apparatus for cleaning between the fins of an air conditioning coil comprising:

a) a portable vacuum blower assembly;

b) a vacuum hose attached to a suction side of said blower assembly;

b) a means for electrically driving said vacuum blower;

c) an elongated brush head assembly attached remotely to an end of said vacuum hose opposite said blower assembly d) a sweeper assembly located within said brush head assembly having an elongated bristle retaining member, with a plurality of bristles attached thereto, extending the approximate length of said brush head assembly;

e) a means for continuously driving said bristle retaining member axially in alternating directions between said fins of air conditioning coils; and f) wherein said means for continuously driving said sweeper brush assembly further comprises:

a) a rotatable wheel connected to a said means for driving;

b) a pivotally offset arm rotatably attached to said wheel having teeth along one side;

c) a cog connected to said sweeper brush having teeth cooperatively engaging said pivot arm; and d) a biasing means for urging, said pivot arm into contact with said cog.

5. A vacuum cleaning apparatus for cleaning between the fins of an air conditioning coil comprising:

a) a portable vacuum blower assembly;

b) a vacuum hose attached to a suction side of said blower assembly;

b) a means for electrically driving said vacuum blower;

c) an elongated brush head assembly attached remotely to an end of said vacuum hose opposite said blower assembly d) a sweeper assembly located within said brush head assembly having an elongated bristle retaining member, with a plurality of bristles attached thereto, extending the approximate length of said brush head assembly;

e) a means for continuously driving said bristle retaining member axially in alternating directions between said fins of air conditioning coils; and f) wherein said brush head assembly comprises:

a) an elongated outer shell having a general "U" shape; and b) an elongated inner shell having a general "U" shape contained within said outer shell and separated therefrom by spacers, said inner shell having a removable partition dividing said inner shell into upper and lower portions.

* * * * *